United States Patent [19]

Jagen et al.

[11] Patent Number: 4,752,240

[45] Date of Patent: Jun. 21, 1988

[54] LATCH-FREE HOUSING FOR ELECTRICAL TERMINALS

[75] Inventors: Paul R. Jagen, Mechanicsburg; Donald R. Leisey, Harrisburg, both of Pa.

[73] Assignee: E. I. Du Pont De Nemours and Company, Wilmington, Del.

[21] Appl. No.: 445,165

[22] Filed: Nov. 29, 1982

[51] Int. Cl.[4] ..... H01R 13/422

[52] U.S. Cl. ..... 439/595; 439/733

[58] Field of Search ..... 339/14 L, 102 R, 220 R, 339/59 R, 59 M, 218 R, 218 M; 439/605, 736, 733, 595, 602, 98, 99

[56] References Cited

U.S. PATENT DOCUMENTS

| | | | |
|---|---|---|---|
| Re. 27,463 | 8/1972 | Sitzler et al. | 339/59 R |
| 2,170,131 | 8/1939 | Doremus | 339/14 L |
| 2,701,867 | 2/1955 | Obenschain et al. | 339/102 R |
| 3,090,936 | 5/1963 | Maltby | 339/210 |
| 3,241,056 | 3/1966 | Lawrence, Jr. | 339/218 R |
| 3,441,661 | 4/1969 | Brummans | 339/220 R |
| 3,543,220 | 11/1970 | Jones | 339/91 |
| 3,654,592 | 4/1972 | Primorac | 339/255 R |
| 3,832,672 | 8/1974 | Loos | 339/14 L |
| 3,993,396 | 11/1976 | Eigenbrode | 339/220 R |
| 4,032,205 | 6/1977 | Taj | 339/14 L |
| 4,092,058 | 5/1978 | Eigenbrode | 339/220 R |
| 4,386,939 | 1/1983 | Foederer | 339/59 M |

*Primary Examiner*—Gil Weidenfeld
*Assistant Examiner*—Gary F. Paumen

[57] ABSTRACT

Connector assembly having a housing with multiple terminal receiving channels therein, each channel open at one end and closed at the other end with apertured closing members, conductive wires having access to the terminals through the aperture. The housing, and conductive wires are encapsulated within a dielectric plastic.

10 Claims, 2 Drawing Sheets

LATCH-FREE HOUSING FOR ELECTRICAL TERMINALS

DESCRIPTION

1. Technical Field

This invention relates to housings for electrical connectors. More particularly, it refers to a latch-free housing for electrical terminals.

2. Background Art

It has been customary in the prior art to design connector housings with integral latches to hold terminals within the housing. Alternatively, terminals are designed with a built-in latch which engages a housing stop and thereby is held in place within the housing. Examples of such housing designs are shown in U.S. Pat. Nos. 3,654,592, 3,781,760 and U.S. Pat. No. Re. 27,463.

Although these prior art housings work well and have been used commercially, a space problem arises inside the housing on close center designs. The necessity of a latch requires more space inside the housing than in a corresponding no-latch design. Moreover, the use of a flexible latch on the housing, as used in U.S. Pat. No. 3,781,760, requires a complex mold. Such molds are expensive. Costs could be decreased if the latch is eliminated. A need, therefore, exists for a latchless housing.

SUMMARY OF THE INVENTION

We have designed a two or more terminal position housing without the need for a flexible latch finger on the housing or on the terminal. The terminal is free-floating and is retained within a housing channel by rear closing flaps. The front portion of the housing contains openings large enough to receive electrically conductive pins but small enough to prevent egress of the terminal. The rear portion of the housing is closed by a pair of hinged flaps containing an aperture for receiving conductive wires. The entire housing, except for the front portion, is encapsulated within a plastic to seal the terminals in place.

BRIEF DESCRIPTION OF THE DRAWINGS

The present invention may be best understood by those having ordinary skill in the art by reference to the following detailed description when considered in conjunction with the accompanying drawings in which.

DETAILED DESCRIPTION OF THE PREFERRED EMBODIMENT

Figure 1A:
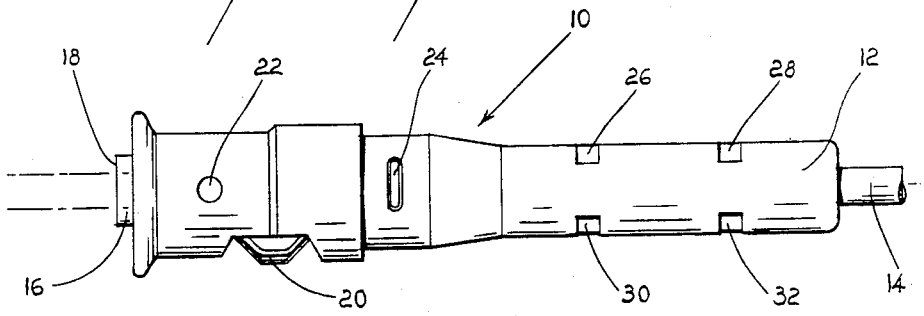
FIG. 1A is an assembly elevation of the connector.

In FIG. 1A, the connector cable assembly 10 is shown with a plastic overmold 12 encapsulating both the cable 14 and the housing 16. Only the front portion 18 of the housing remains exposed. A ground lug 20 protrudes through the plastic overmold 12. A series of voids 22, 24, 26, 28, 30 and 32 are present only as a convenience in the molding process. These voids do not effect the operation of the connector.

Figure 1B:
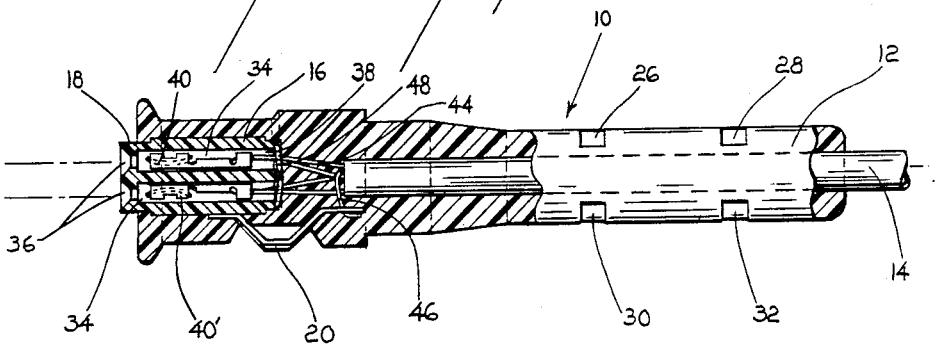
FIG. 1B is a partial cut-away of the connector assembly showing an interior view.

The identical channels 34 running from the front opening 36 to the rear opening 38 of the housing 16 is shown in FIG. 1B. Each channel 34 provides space for a terminal 40. The front end 18 of the housing 16 has multiple pin-receiving channel openings 36. The rear channel openings 38 are covered by a pair of flaps 48 having opposed U-shaped or semi-circular openings forming an aperture 42 for receiving the wire conductors from cable 14. A ground wire 46 from the cable 14 is attached to the ground lug 20. The flaps 48 can have dovetails 50 on their ends to facilitate mutual engagement. The flaps 48 are each hinged 52 from a portion of the housing 16. The hinges 52 will be a fracture zone in the plastic of the housing 16.

Figure 2:
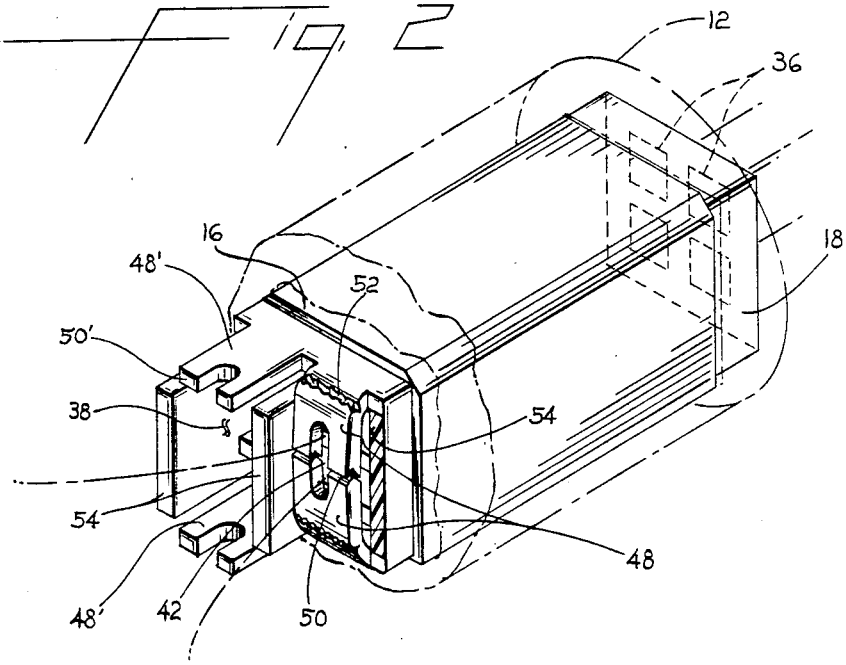
FIG. 2 is a rear view isometric of the connector housing with the exterior plastic covering in phantom.

An alternative design for the flaps 48 is also shown in FIG. 2 where the flaps 48' have a flat bottom surface 50' instead of a dovetail. Preferably, a pair of sidewalls 54 are located on each side of the rear channel opening 38 so that the flaps 48 or 48' are wedged between these sidewalls 54 in their closed position.

Figure 3:
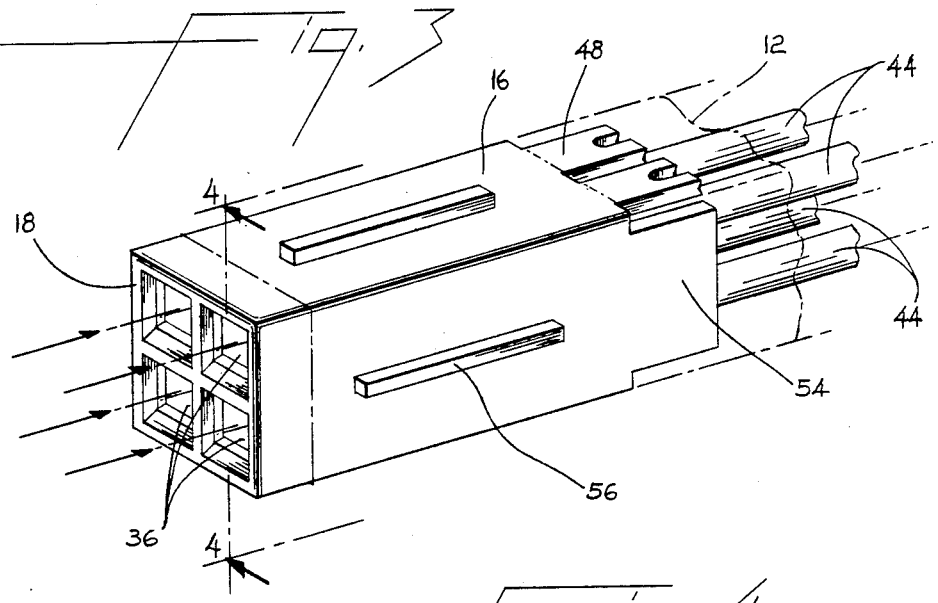
FIG. 3 is a front view prospective of the connector housing with an alternate exterior design of the housing and the exterior plastic covering in phantom.

FIG. 3 shows an optional housing design with protrusions 56 facilitating bonding of the plastic overmold 12 to the housing.

Figure 4:
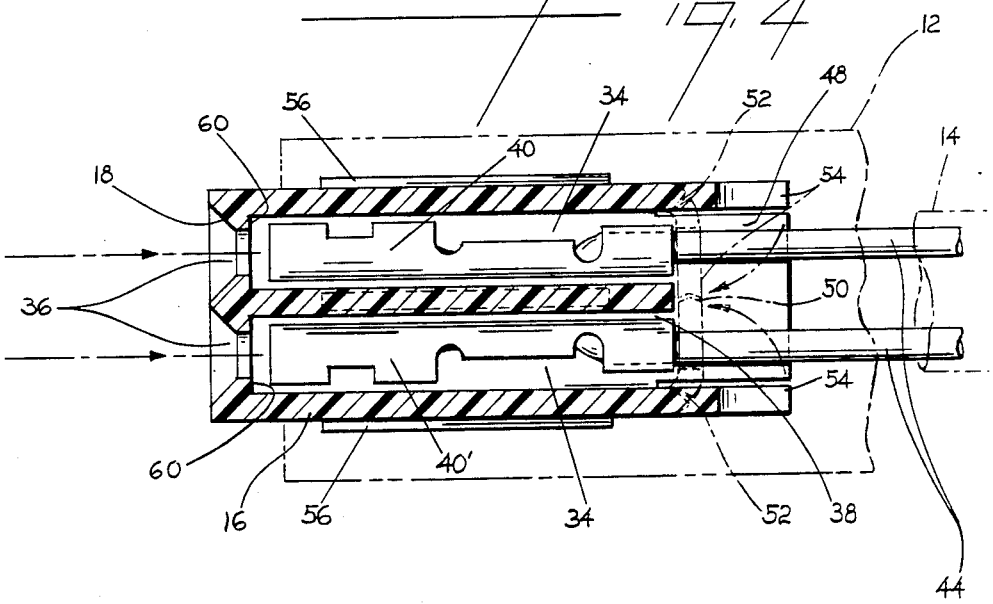
FIG. 4 is a cross-section of the housing with exterior plastic covering in phantom taken along line 4—4 in FIG. 3.

FIG. 4 shows the location of the terminals 40 within the housing. The terminals 40 cannot move any further forward in the housing than stop 60 and cannot move back through the rear opening of the housing because of the closed flaps 48. However, the aperture 42 in the flaps allow access for the conductors 44 from cable 14 to enter into the housing channels 34. The conductors 44 are attached to the terminals by crimping or soldering. In the particular design shown in FIG. 1B, two conductors 44 from the cable 14 are terminated to the top two terminals 40 and two other conductors 44 from cable 14 are terminated to the lower two terminals 40'. A ground wire 46 in the cable 14 is attached to the ground lug 20. The exact number of wires in the cable 14 depends on the particular design and use of terminals involved. The specific design of the terminal can vary with the connector requirements.

After the conductor wires 44 are terminated to the terminals 40 and 40' and the flaps 48 are closed, the cable 14 and the housing 16 are encapsulated within a layer of plastic 12. This plastic can be a polyester or polyvinyl chloride, but other plastics of like kind can be substituted. Encapsulation is achieved by inserting the housing 16 and cable 14 into a mold and injecting the mold with molten plastic such as polyvinyl chloride. The housing front portion 18 protrudes from the mold along with the ground lug 20.

The housing is made from any common dielectric plastic such as polycarbonate. The terminal is a metal such as copper, cupro-nickel or phosphor bronze. The overmold 12 does not cover the front portion 18 of the housing which contains the channel openings 36 for receiving the conductive pins. Neither does it cover the ground lug. The remainder of the housing 16 and cable 14 are completely sealed from the external environment. The ground lug will usually be made of copper or other conductive materials.

Having thus described the invention, what is claimed and desired to be secured by Letters Patent is:

1. A connector assembly containing a dielectric housing with multiple terminal receiving channels, each channel having a front and rear opening to the exterior at opposite ends of the housing, an electrical terminal occupying each channel, the front opening of each channel being large enough to accommodate an electrically conductive pin but small enough to prevent egress of the terminal, the rear opening being covered by a closing member formed by fracturing a portion of the housing adjacent to the rear opening, the closing member containing an aperture sufficient to provide access for a conductive wire attached to each terminal, the housing being encapsulated within a dielectric plastic so that the end of the housing containing the rear opening and the closing member together with the conductive wires are sealed from the external environment.

2. A connector assembly according to claim 1 wherein the closing member is a pair of flaps, each hinged on a fracture zone of the housing on opposite sides of the rear opening, each flap having a U-shaped aperture, located on an edge opposite the fracture zone, opposed to a corresponding U-shaped aperture in the other flap, which in the closed position forms the aperture for receiving the conductive wires.

3. A connector assembly according to claim 2 wherein each pair of flaps cover two of said rear openings.

4. A connector assembly according to claims 1, 2 or 3 wherein the dielectric plastic is polyvinyl chloride.

5. A connector assembly according to claim 1 wherein there are four terminal receiving channels.

6. A connector assembly according to claim 5 wherein there are five conductive wires, one being a ground and each of the remaining four being signal conductors in separate electrical contact with an electrical terminal occupying a channel within the housing.

7. A connector assembly according to claim 6 wherein the ground wire is connected to a ground lug mounted on the housing exterior and penetrating through the encapsulating dielectric plastic.

8. A connector assembly according to claim 7 wherein the encapsulating dielectric plastic covers the conductive wires, the closing members and the remainder of the housing exclusive of the front opening and the ground lug.

9. A connector assembly comprising a dielectric housing containing multiple elongated terminal receiving channels from a front to a rear of the housing, each channel containing an electrical terminal capable of receiving an electrically conductive pin at a first end and a wire conductor from a cable assembly at a second end, the first end of the terminal being blocked from egress from the front of the housing by a stop in the channel, the second end being blocked from egress from the rear of the housing by a pair of flaps hinged on a fracture zone of the housing located on opposite sides of the rear of the housing, each flap having opposed U-shaped openings which in the closed position form an aperture for receiving the wire conductors; and the housing, the wire conductors and cable being encapsulated within a dielectric plastic to seal the terminals within the housing, permitting access to the terminals solely by electrically conductive pins through the front of the housing.

10. The connector housing according to claim 9 wherein each pair of flaps block two terminals from egress.

* * * * *